US006609339B1

(12) United States Patent
Pardue

(10) Patent No.: US 6,609,339 B1
(45) Date of Patent: Aug. 26, 2003

(54) METHOD AND APPARATUS FOR COUPLING WALL PANELS OF A BUILDING

(76) Inventor: William Pardue, 9625 SW. Tualatin-Sherwood Rd., Tualatin, OR (US) 97062

( * ) Notice: Subject to any disclaimer, the term of this patent is extended or adjusted under 35 U.S.C. 154(b) by 0 days.

(21) Appl. No.: 09/888,981

(22) Filed: Jun. 22, 2001

(51) Int. Cl.[7] ..... E04B 2/96

(52) U.S. Cl. ..... 52/235; 52/506.05; 52/506.09; 52/509; 52/511; 52/512; 52/513

(58) Field of Search ..... 52/506.01, 506.05, 52/506.08, 506.09, 509.51, 511, 512, 513, 235

(56) References Cited

U.S. PATENT DOCUMENTS

| | | | | | |
|---|---|---|---|---|---|
| 3,715,850 | A | * | 2/1973 | Chambers | 52/701 |
| 4,060,951 | A | * | 12/1977 | Gere | 52/508 |
| 4,307,551 | A | * | 12/1981 | Crandell | 52/508 |
| 4,570,401 | A | * | 2/1986 | Uebel et al. | 52/235 |
| 4,625,481 | A | * | 12/1986 | Crandell | 52/235 |
| 4,744,191 | A | * | 5/1988 | Fricker | 52/702 |
| 5,094,057 | A | * | 3/1992 | Morris | 52/391 |
| 5,283,992 | A | * | 2/1994 | Morassutti | 52/509 |
| 6,098,364 | A | * | 8/2000 | Liu | 52/506.08 |
| 6,289,646 | B1 | * | 9/2001 | Watanabe | 52/506.01 |
| 6,425,218 | B1 | * | 7/2002 | Doyon et al. | 52/235 |
| 6,427,410 | B1 | * | 8/2002 | Lind | 52/508 |
| 6,442,911 | B2 | * | 9/2002 | Elmer et al. | 52/506.01 |

* cited by examiner

*Primary Examiner*—Carl D. Friedman
*Assistant Examiner*—Yvonne M. Horton
(74) *Attorney, Agent, or Firm*—Birdwell, Janke & Durando, PLC

(57) ABSTRACT

A method and apparatus for coupling panels to a structure. A coupling assembly includes a first coupling member depending from a face of one of the panels and adapted to deflect a relatively large amount in a plane of rotation of the first coupling member and a second coupling member depending from the corresponding face of the second panel. A coupling mechanism is provided between the coupling members provides for transmitting a force between the coupling members over a range of deflection of the first coupling member, permitting large relative movement between the panels.

25 Claims, 1 Drawing Sheet

METHOD AND APPARATUS FOR COUPLING WALL PANELS OF A BUILDING

BACKGROUND OF THE INVENTION

The present invention relates to a method and apparatus for coupling wall panels of a building or other structure, such as a pre-cast concrete or brick facades. More particularly, the invention relates to coupling the panels to one another so that the panels are permitted to move relative to one another during an earthquake while remaining coupled together.

Earthquakes will often loosen or damage decorative or structural wall panels, such as pre-cast concrete or brick facades. In response to larger earthquakes, the panels may become detached from the structure and fall to the ground, potentially causing injury, property damage and even death. Other natural or man-made forces may also pose threats to the structural integrity of building panels.

Fukumoto et al., U.S. Pat. No. 5,163,256, proposes an elasto-plastic damper to couple non-structural partition walls to a building so that the coupling is resistant to earthquakes and high winds. The damper comprises a cylindrical shaft with a constricted waist portion that elastically and plastically deforms in response to forces in a plane perpendicular to the longitudinal axis of the waist portion. A problem with this approach is that it provides for limited amounts of elastic and plastic deformation and, therefore, limited relative motion between the partition wall and building. This is because metal materials, the strength of which would be necessary to support the weight of heavy partition walls, will not elastically or plastically deform large amounts before breaking even where the materials are annealed. Limiting the relative motion of the partition wall and building limits the amount of energy that can be dissipated.

Frobosilo et al., U.S. Pat. No. 5,846,018, proposes a seismic slide clip deflection assembly including a plate member for attachment to a frame of a building, an angle clip member having a 90 degree bend and a base slide plate member in which the angle clip member is horizontally slidingly received. The angle member includes a vertically oriented slot through which extends a head rivet and spring washer functioning as slidable friction means to slidingly secure the angle member to the plate member while eliminating joint play. The approach has the serious drawback of permitting relative horizontal displacement of the parts coupled together along a single axis.

Accordingly, there is a need for a novel and improved method and apparatus for coupling wall panels of a building or other structure that provides for relatively large movements of the panels with respect to one another during an earthquake along two orthogonal axes.

SUMMARY OF THE INVENTION

The method and apparatus for coupling wall panels of a building of the present invention solves the aforementioned problems and meets the aforementioned needs by providing a coupling assembly including a first coupling member depending from a face of one of the panels at a point and having an end. The first member is adapted to deflect a relatively large amount in a plane of rotation of the first coupling member about the point by extending a distance from the point that is large relative to the thickness of the member defined in the same plane.

In an unstressed position of the first member, the end is spaced from a corresponding face of the second panel a first distance that is at least equal to a first predetermined maximum amount of deflection of the end in the plane toward the second panel, this first amount of deflection being associated with rotation of the first member about the point in the plane in one direction.

A second coupling member depending from the corresponding face of the second panel extends a second distance beyond the unstressed position of the end of the first coupling member that is at least equal to a second predetermined maximum amount of deflection of the end in the plane away from the second panel. This second amount of deflection is associated with rotation of the first member about the point in the plane in the opposite direction.

A coupling mechanism is provided between the coupling members that is maintained over the range of deflection between the first and second predetermined maxima. The coupling mechanism provides for transmitting a force between the coupling members over this range, permitting large relative movement between the panels along the first axis.

Preferably, the second coupling member is received at the second panel so that it is constrained to translate laterally across the face of the second panel along a second axis that is perpendicular to the first axis and to the plane, to permit large relative movement between the panels along the second axis.

Preferably, the first coupling member includes an aperture for receiving the second coupling member therethrough, and the aperture is preferably formed as an elongate slot oriented along a third axis that is perpendicular to both the first and second axes, to accommodate large relative movement between the panels along the third axis, which is preferably a vertical axis.

Therefore, it is a principal object of the present invention to provide a novel and improved method and apparatus for coupling wall panels of a building.

It is a further object of the present invention to provide a method and apparatus for coupling wall panels of a building that provides for a higher degree of resistance to earthquake damage to the panels and to the coupling.

It is still a further object of the present invention to provide such a method and apparatus for coupling wall panels of a building that provides for relatively large, horizontal displacements of one panel with respect to another.

It is yet a further object of the present invention to provide such a method and apparatus for coupling wall panels of a building that provides for relatively large, horizontal movements of the panels with respect to one another.

It is another object of the present invention to provide such a method and apparatus that provides for such relatively large movements of the panels with respect to one another along two orthogonal axes.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1:
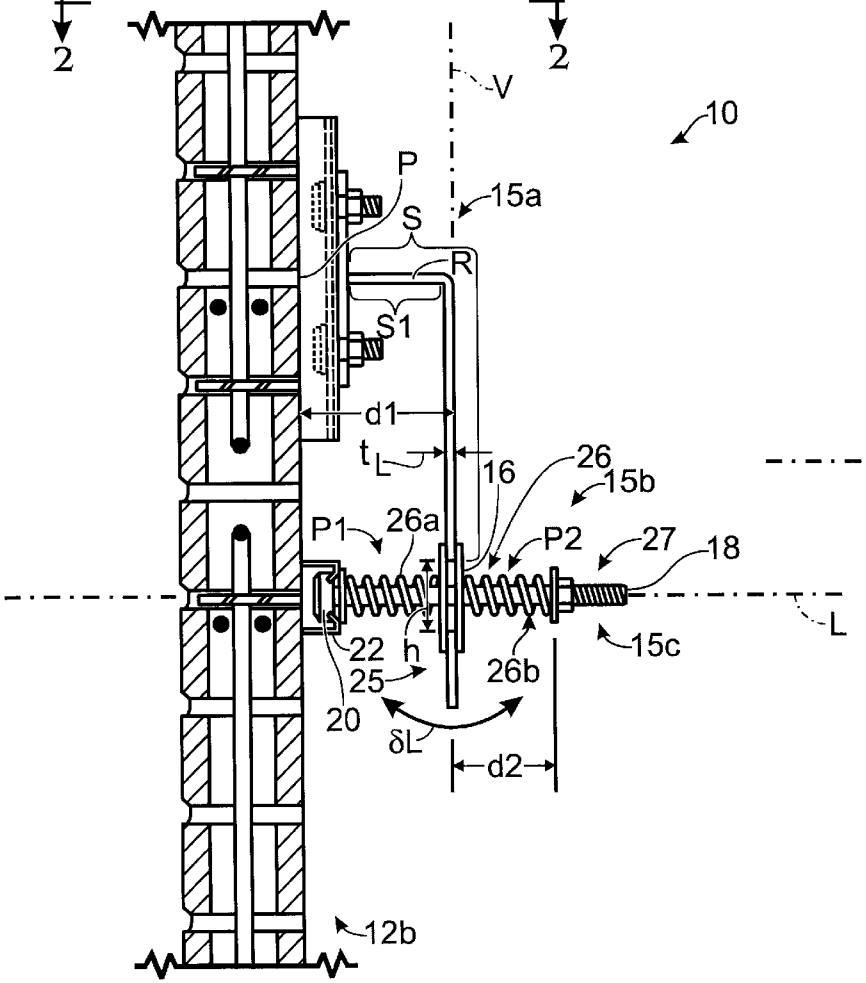
FIG. 1 is a cross-sectional side view of an apparatus for coupling two panels of a building according to the present invention.

Referring to FIG. 1, an apparatus 10 for coupling two wall panels 12*a*, 12*b* of a building according to the present invention is shown. Panels such as the panels 12 are typically decorative and applied to sides of a multi-story building, such as pre-cast concrete or brick spandrel panels and column covers; however, the apparatus 10 may be employed for coupling other types of decorative or structural panels used in or on other types of structures at other locations thereof without departing from the principles of the invention. The panels may be joined or attached to the structure in any manner known in the art; however, the present invention provides an additional or safety coupling between the panels in the event that these prior art connections fail for some of the panels.

The panels are typically attached to the building so that they abut one another in a side-by-side disposition, e.g., the top side of one of the panels abuts the bottom side of a panel thereabove, or the right side of one of the panels abuts the left side of a panel therebeside. However, the panels may overlap one another, or the sides may be spaced apart from one another, and the principles of the invention will remain applicable.

A coupling assembly is provided according to the invention that includes first and second coupling members 15*a*, 15*b* for coupling together the panels 12. Each of the coupling members 15*a* and 15*b* is preferably formed of a structural metal such as steel in an elongate configuration such as but not limited to the respective configurations shown in the Figure. With reference to these exemplary configurations and the explanation herein, persons of ordinary skill will readily appreciate how to provide the features of the invention in alternative configurations.

The first coupling member 15*a* depends from the interior face of a first panel 12*a* from a fixed location "P" thereon. With reference to the typical vertical orientation of the panels 12, the first coupling member 15*a* extends from the point "P" downwardly to the panel 12*b* below. The first coupling member is adapted to provide a large deflection δL that is associated with bending of the member about the point "P" in the plane of FIG. 1, particularly at an end 25 thereof The force producing this bending is applied by the second coupling member 15*b* as described below.

The first coupling member 15*a* is preferably adapted to provide for a large deflection δL by providing an effective length "s" of the member that is substantially larger than a representative cross-sectional thickness "$t_L$" of the member over the length "s." The thickness "$t_L$" is defined in the plane of FIG. 1 and need not be constant. This configuration effectively multiplies any deformation at the point "P" (where bending stress on the member 15*a* will be greatest) by a factor of $s/t_L$. Accordingly, the amount of deflection δL may be much greater than the amount of deformation or strain that the coupling member can endure without breaking. Typically, the thickness "$t_L$" is at least about 50–100 times less than the distance "s." However, a ratio of about 10 or more in the dimensions "s" and "$t_L$" is sufficient for the differences between these dimensions to be considered substantial for purposes herein, providing for a relatively large deflection as a result of bending of the first coupling member in the pertinent plane.

For small earthquakes, deformation of the member 15*a* may be elastic and therefore reversible, while for larger earthquakes, deformation may include plastic deformation which permanently deforms the member. If the stress at the point "P" exceeds the limit for elastic deformation and the member plastically deforms at "P," the member will become work-hardened at this location, so that further deformation will occur elsewhere along the length of the member before the member breaks. This illustrates a further advantage of employing a relatively long length "s." That is, work or strain-hardening at one point causes further deformation to occur in adjacent points, thereafter hardening the adjacent points and so on over the length "s," rather than the member simply breaking at the one point in response to further application of force.

To provide the desired range of deflection δL, the end 25 of the first member 15*a* in a neutral, unstressed position (shown in FIG. 1) is spaced from the panel 12*b* a distance "d1" that is preferably at least equal to a first predetermined maximum amount of the deflection δL. In the example of FIG. 1, this deflection is associated with rotation of the member 15*a* about the point "P" in the plane of FIG. 1 in the clockwise direction, i.e., toward the panel 12*b*. The spacing "d1 " may be provided by an outwardly extending portion "R" of the first coupling member as shown in FIG. 1, or may be similarly provided simply by spacing the coupling member away from the panel 12*a*, as one alternative.

The second coupling member 15*b* depends from the interior face of the second panel 12*b* and includes an extension portion 15*c* that extends outwardly from the panel 12*b*, preferably, along the axis "L," which is perpendicular to the panel.

The extension portion 15*c* is provided to extend a distance "d2" beyond the unstressed position of the end of the first coupling member that is preferably at least equal to a second predetermined maximum amount of the deflection δL. In the example of FIG. 1, this deflection is associated with rotation of the member 15*a* about the point "P" in the plane of FIG. 1 in the counterclockwise direction, i.e., away from the panel 12*b*.

A coupling mechanism is provided between the coupling members that is maintained over the range of deflection between the first and second maxima of δL, the coupling mechanism providing for transmitting a force between the coupling members over this range.

The extension portion of the second coupling member extends through an aperture 16 through the first coupling member so that a first portion "P1" of the extension portion 15*c* is disposed on one side of the first coupling member 15*a* and extends at least the first distance "d1" and a second portion "P2" of the extension portion is disposed on the other side of the first coupling member and preferably extends at least the second distance "d2" from the end 25 of the first coupling member in the unstressed position.

A spring 26 of any desired configuration may be provided at any appropriate location to bias the second coupling member toward its unstressed position. Preferably, at least one coil spring receives therethrough or has its coils disposed about a selected one of the portions of the second member. More preferably, two springs 26*a*, 26*b* are provided, each having coils disposed about a respective one of the portions of the second member, to double the strength of the spring bias. One of the springs 26*a* is captured between the panel 12*b* and the end 25 of the first coupling member, and the other spring 26*b* is captured between the end 25 and an end 27 of the extension portion 15*c* member as shown in FIG. 1.

Without departing from the principles of the invention, however, a simple example of a coupling mechanism that may provide the above-described function is a pair of nuts provided on a threaded extension portion 15*c* of the second coupling member, disposed on opposite sides of the aperture 16. All deflection would be accommodated in this example by bending of the first coupling member.

Since the deflection δL is enabled by the configuration of the member 15*a* to be relatively large without risk of breaking the member 15*a*, relatively large translations of the panel 12*b* with respect to the panel 12*a* along the axis "L" are accommodated by the apparatus 10.

Figure 2:
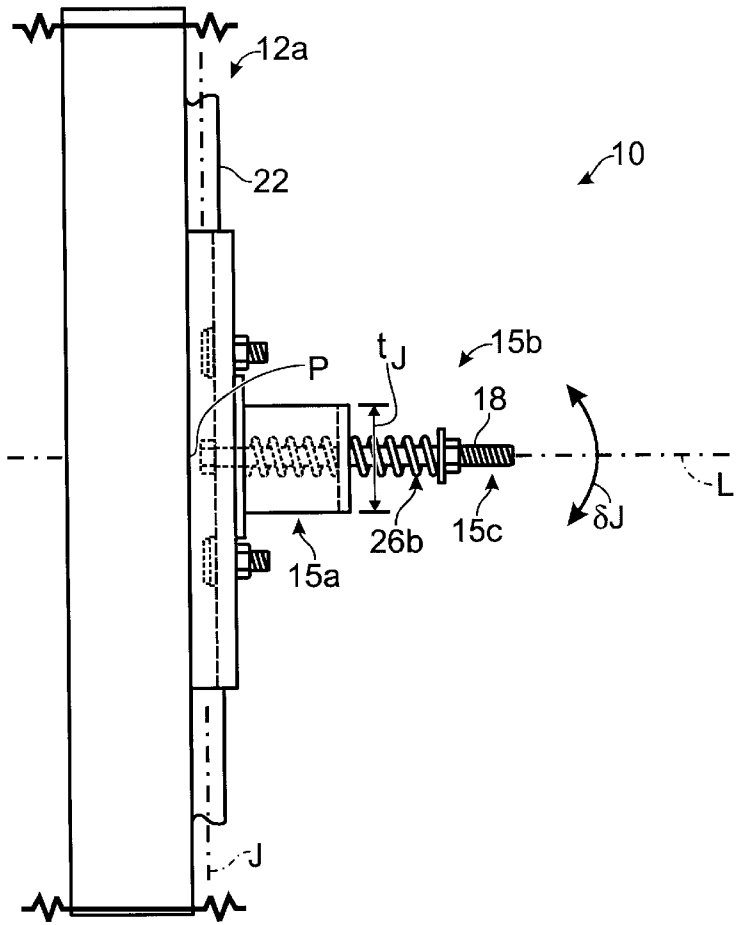
FIG. 2 is a front view of the apparatus of FIG. 1, taken along a line 2—2.

To provide for deflection in a lateral axis, the second coupling member 15*b* is attached to the panel 12*b* so that it is constrained to translate horizontally along the panel along an axis "J" that is perpendicular to the plane of FIG. 1 and that is shown in FIG. 2. One suitable embodiment of the coupling member 15*b* for this purpose comprises a cylindrical rod 18 for use as the extension portion 15*c* extending along an axis "L" that is perpendicular to the panel 12*b*. The rod has a head 20 of larger diameter than the cross-sectional diameter of the rod, such as where the rod is a bolt. The head of the rod is captured by and rides slidingly in a channel 22 attached to the panel 12*b*. The channel has a C-shaped cross-section for slidingly receiving the head of the rod. Other structures providing the same or similar features may be employed without departing from the principles of the invention.

Relative movement of the panels 12 along the axis "J" may be accommodated by translation of the extension portion 15*c* such as by sliding as provided in the preferred embodiment. Although other structures may provide for this translation, the preferred bolt and channel is economical. Such translation is, however, resisted by the coupling member 15*a* at the aperture 16, by a deflection δJ that is associated with bending of the member about the point "P" in the plane of FIG. 2 at the end 25. As for the deflection δL, the deflection δJ is maximized by providing that the thickness "$t_J$" of the coupling member 15*a*, defined in the plane of FIG. 2, for rotation of the member 15*a* about the point "P" in this plane, is small relative to the effective length "s" of the member. Also similarly to the deflection δL, the deflection δJ multiplies the deformation at "P" along the "J" axis by the factor $s/t_J$ to provide for large relative movements of the panels along the "J" axis.

Preferably, both deflections δL and δJ are maximized in the manner described above; however, since deflections along the "L" and "J" axes are independent of one another, just one of these deflections may be selected for maximization where this is desirable, e.g., where there are geological or structural reasons for it being unnecessary to accommodate deflections equally along the two axes. For example, the coupling member 15*a* may be a piece of sheet metal oriented so that it is characterized by a larger $t_J$ while retaining a small $t_L$ (such as shown in FIG. 1), so that δL is greater than δJ.

A relative movement δV of the panels 12 along a vertical axis "V" is preferably accommodated by forming the aperture 16 as a slot having a vertical orientation. The height "h" of the slot is selected to provide the desired freedom of movement, $\delta V_{max}$. Moreover, if such relative movements exceed the range provided by the slot, the length "sl" of that portion of the coupling member 15*a* that functions as a lever for torque applied about the point "P" as a result, may function analogously to provide an additional deflection δVa along the axis V as does the length "s" for the deflection δL. As just one alternative to forming the aperture 16 as a slot, the aperture 16 may simply be a circular hole having a diameter "h."

The apparatus 10 in its entirety is seen to provide for large relative movements of the panels along three orthogonal axes, "L," "J," and "V" while retaining a coupling therebetween. This is particularly useful for maintaining the integrity of the coupling during an earthquake and, therefore, preventing or minimizing injury and property damage. The invention may also be useful to accommodate for other natural or man-made stresses to which the structure may be subjected, such as wind or blast. However, as mentioned above in connection with the deflections δL and δJ, any selected limited set of the deflections δL, δJ, δV, and δVa may be provided in accord with a design choice for a particular structure in particular geologic or other environmental conditions by an apparatus according to the present invention without departing from the principles thereof.

It is to be recognized that, while a particular method and apparatus for coupling panels to a structure has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

What is claimed is:

1. An assembly of coupled wall panels, comprising:

a first wall panel having a first face;

a second wall panel having a corresponding second face;

a first coupling member depending from said first face at a point thereon and extending outwardly therefrom, wherein the thickness of said first coupling member measured along at least a first axis perpendicular to said first face is less than the amount that said first coupling member is spaced from said first wall panel along said first axis;

a second coupling member depending from said second face and having an extension portion extending outwardly therefrom along said first axis, and terminating in an end of said second coupling member, the length of said extension portion being adapted so that said extension portion extends beyond said first coupling member; and a spring coupling mechanism for coupling said second coupling member and said first coupling member together, said spring coupling mechanism having a first spring disposed so that relative movement between said coupling members in the direction of said first axis compresses said first spring.

2. The assembly of claim 1, further comprising a second spring disposed on said extension portion, wherein relative movement in a direction toward said first face compresses said first spring and relative motion in a direction away from said first face compresses said second spring.

3. The assembly of claim 2, wherein said first and said second springs are coaxially disposed on said extension portion.

4. The assembly of claim 3, wherein said first coupling member includes an aperture therethrough, wherein said extension portion is adapted to extend through said aperture when said first and second coupling members are mounted to said wall panels.

5. The assembly of claim 4, wherein said aperture is an elongate slot having and elongate axis oriented along a second axis that is substantially perpendicular to said first axis.

6. The assembly of claim 5, wherein said second coupling member includes an attachment adapted for mounting said second coupling member to said second wall panel, and for receiving said extension portion so as to constrain said extension portion to lateral translation across said face of said second panel along a third axis perpendicular to said first and second axes.

7. The assembly of claim 6, wherein said attachment includes an elongate channel adapted for orientation along said third axis, wherein said extension portion includes a head that is adapted to be slidingly received in said channel.

8. The assembly of claim 1, wherein said first coupling member depends from said first face so as to extend in a first direction perpendicular to said first face and thereafter changes direction so as to extend in a second direction parallel to said first face and be spaced apart from said first face a distance that is greater than said thickness.

9. The assembly of claim 3, wherein said first coupling member depends from said first face so as to extend in a first direction perpendicular to said first face and thereafter changes direction so as to extend in a second direction parallel to said first face and be spaced apart from said first face a distance that is greater than said thickness.

10. The assembly of claim 5, wherein said first coupling member depends from said first face so as to extend in a first direction perpendicular to said first face and thereafter changes direction so as to extend in a second direction parallel to said first face and be spaced apart from said first face a distance that is greater than said thickness.

11. The assembly of claim 7, wherein said first coupling member depends from said first face so as to extend in a first direction perpendicular to said first face and thereafter changes direction so as to extend in a second direction parallel to said first face and be spaced apart from said first face a distance that is greater than said thickness.

12. An assembly for coupling a first wall panel having a first face and a second wall panel having a corresponding second face, the assembly comprising;

a first coupling member for mounting to the first face at a point thereon and extending outwardly therefrom, wherein the thickness of said first coupling member measured along at least a first axis perpendicular to the first face is less than the amount that said first coupling member is spaced from the first wall panel along said first axis;

a second coupling member for mounting to the second face and having an extension portion extending outwardly therefrom along said first axis, and terminating in an end of said second coupling member, the length of said extension portion being adapted so that said extension portion extends beyond said first coupling member; and a spring coupling mechanism for coupling said second coupling member and said first coupling member together, said spring coupling mechanism having a first spring disposed so that relative movement between said coupling members in the direction of said first axis compresses said first spring when said first and second coupling members are mounted to the respective wall panels.

13. The assembly of claim 12, further comprising a second spring disposed on said extension portion, wherein relative movement in a direction toward the first face compresses said first spring and relative motion in a direction away from the first face compresses said second spring when said first and second coupling members are mounted to the respective wall panels.

14. The assembly of claim 13, wherein said first and said second springs are coaxially disposed on said extension portion.

15. The assembly of claim 14, wherein said first coupling member includes an aperture therethrough, wherein said extension portion is adapted to extend through said aperture when said first and second coupling members are mounted to the respective wall panels.

16. The assembly of claim 15, wherein said aperture is an elongate slot having and elongate axis oriented along a second axis that is substantially perpendicular to said first axis when said first and second coupling members are mounted to the respective wall panels.

17. The assembly of claim 16, wherein said second coupling member includes an attachment adapted for said mounting of said second coupling member, and for receiving said extension portion so as to constrain said extension portion to lateral translation across the face of the second panel along a third axis perpendicular to said first and second axes when said first and second coupling members are mounted to the respective wall panels.

18. The assembly of claim 17, wherein said attachment includes an elongate channel adapted for orientation along said third axis, wherein said extension portion includes a head that is adapted to be slidingly received in said channel when said first and second coupling members are mounted to the respective wall panels.

19. The assembly of claim 12, wherein said first coupling member, when mounted to the first wall panel, depends from the first face so as to extend in a first direction perpendicular to the first face and thereafter changes direction so as to extend in a second direction parallel to the first face and be spaced apart from the first face a distance that is greater than said thickness.

20. The assembly of claim 14, wherein said first coupling member, when mounted to the first wall panel, depends from the first face so as to extend in a first direction perpendicular to the first face and thereafter changes direction so as to extend in a second direction parallel to the first face and be spaced apart from the first face a distance that is greater than said thickness.

21. The assembly of claim 16, wherein said first coupling member, when mounted to the first wall panel, depends from the first face so as to extend in a first direction perpendicular to the first face and thereafter changes direction so as to extend in a second direction parallel to the first face and be spaced apart from said the first face a distance that is greater than said thickness.

22. The assembly of claim 18, wherein said first coupling member, when mounted to the first wall panel, depends from said first face so as to extend in a first direction perpendicular to the first face and thereafter changes direction so as to extend in a second direction parallel to the first face and be spaced apart from the first face a distance that is greater than said thickness.

23. A method for coupling a first wall panel having a first face and a second wall panel having a corresponding second face, the method comprising the steps of:

mounting a first coupling member to the first face at a point thereon so that said first coupling member extends outwardly therefrom, wherein the thickness of said first coupling member measured along at least a first axis perpendicular to the first face is less than the amount that said first coupling member is spaced from the first wall panel along said first axis;

mounting a second coupling member to the second face so that an extension portion of the second coupling member extends outwardly from the second face along said first axis and extends beyond the first coupling member; and coupling said second coupling member and said first coupling member together so that relative movement between said coupling members in the direction of said first axis compresses a first spring.

24. The method of claim 23, including coupling said second coupling member and said first coupling member together so that movement of the first coupling member with respect to the second coupling member in a direction toward the first face compresses the first spring and movement of the first coupling member with respect to the second coupling member in a direction away from the first face compresses a second spring.

25. The method of claim 24, wherein said mounting of said second coupling member permits constrained, linear lateral movement of the second coupling member with respect to the second face.

* * * * *